United States Patent [19]

Kicherer et al.

[11] Patent Number: 4,861,969

[45] Date of Patent: Aug. 29, 1989

[54] ELECTRIC HOTPLATE, APPARATUS AND METHOD FOR FITTING A COVER PLATE THERETO

[75] Inventors: Robert Kicherer; Felix Schreder; Stefan Reif, all of Oberderdingen, Fed. Rep. of Germany

[73] Assignee: E.G.O. Elektro-Gerate Blanc u. Fischer, Fed. Rep. of Germany

[21] Appl. No.: 170,275

[22] Filed: Mar. 18, 1988

[30] Foreign Application Priority Data

Mar. 22, 1987 [DE] Fed. Rep. of Germany ..... 3709438

[51] Int. Cl.[4] ..... H05B 3/70

[52] U.S. Cl. ..... 219/458; 219/464

[58] Field of Search ..... 219/458, 457, 459, 464, 219/450, 460

[56] References Cited

U.S. PATENT DOCUMENTS

| | | | |
|---|---|---|---|
| 3,870,861 | 3/1975 | Werych | 219/464 |
| 4,680,452 | 7/1987 | Fischer | 219/450 |

FOREIGN PATENT DOCUMENTS

| | | | |
|---|---|---|---|
| 1160669 | 1/1984 | Canada | 219/460 |
| 0070043 | 8/1980 | European Pat. Off. . | |
| 631467 | 6/1936 | Fed. Rep. of Germany . | |
| 0113923 | 12/1983 | Fed. Rep. of Germany . | |
| 3514083 | 11/1985 | Fed. Rep. of Germany . | |
| 0279367 | 12/1988 | Fed. Rep. of Germany . | |
| 532601 | 1/1941 | United Kingdom | 219/457 |
| 574231 | 12/1945 | United Kingdom | 219/457 |

*Primary Examiner*—Teresa J. Walberg

*Attorney, Agent, or Firm*—Steele, Gould & Fried

[57] ABSTRACT

The lower cover plate of an electric hotplate is fixed to the hotplate body by a resilient fixing structure provided on the cover plate, engaging with gripping edges on the outer face of a downwardly directed, central cast pin. The fixing structure can be defined by radial or flap-like, inwardly-directed portions of the cover plate and additionally can have portions engaging on the lower face of the pin and which are firmly held by the final screwing down of the electric hotplate.

18 Claims, 4 Drawing Sheets

ELECTRIC HOTPLATE, APPARATUS AND METHOD FOR FITTING A COVER PLATE THERETO

BACKGROUND OF THE INVENTION

1. Field of the Invention

The invention relates to an electric hotplate with a hotplate body have a central, downwardly projecting pin and with a cover plate covering the underside of the body, as well as to an apparatus and a method for the fitting thereof.

2. Prior Art

In the case of conventional electric hotplates of this type, e.g. according to German patent No. 631 467, a screw-bolt is screwed into the central pin and projects through an opening of the cover plate, securing the latter with a nut. The screw-bolt then projects further downwards and secures the hotplate through a further nut fitted thereto to a cooker or clamping component. It is possible to use standard screws, but a long screw-bolt projecting beyond the underside of the hotplate leads to difficulties during storage and transportation.

EP-A-No. 70 043 discloses an electric hotplate of the aforementioned type, in which the cover plate is secured by a hollow screw having an external and an internal thread, screwed into the pin. A bolt for fixing the hotplate to the cooker or hob components can then be screwed into the internal thread. This solution is much more space-saving during storage and transportation, because it does not lead to any downwardly projecting bolt lengths in the plate ready for assembly, but the double screw constitutes a special, non-standardized component, whose costs cannot be ignored.

SUMMARY OF THE INVENTION

An object of the present invention is to provide an electric hotplate, an apparatus and a method, in which the fixing of the cover plate can take place particularly inexpensively, taking into account automatic mass production, but can still take place in a reliable manner without loss of the advantages of a hotplate with no fixing parts projecting from the bottom in connection with storage and transportation.

According to the invention this object is achieved by an electric hotplate, in which the cover plate is secured by a screwless fixing means provided between the outer face of the pin and a cover plate recess surrounding the pin.

The fixing means can be constituted by a preferably barb-like claw means, snapping means or, in particularly preferred manner, a securing means using projections formed by notching of the marginal region of the pin. In the case of securing by notching, using the pin as a male member during the pressing-on process, the cover plate can be deformed to give a nozzle-like collar, which engages on the outer face of the pin and guides the latter, so that the notches only constitute a securing means.

The fixing means can also comprise gripping edges shaped in one piece from the cover plate and which are resiliently engaged in barb-like manner on the outer face of the pin. This is advantageously assisted by the pin surface, which is normally rough due to its casting, if the hotplate body is made from cast metal in preferred manner. Although it has proved that normally the unworked surface of the pin is adequate, it is also possible to provide a depression, e.g. a circumferential groove therein, into which the fixing means snaps. The fixing means can comprise individual elements projecting inwards towards the pin and which extend inwardly in radial or star-like manner, i.e. separated by indentations. They can spring individually and act in the same way as a self-locking ring of barbs when pressed onto the pin. Instead of a central pin, it is also possible to have a plurality of pins in the central hotplate regions.

On the cover plate in the advantageously cup-shaped, upwardly formed fixing region are provided bent flaps engaging on the lower face of the pin and on the one hand forming an end stop during pressing-on of the cover plate and on the other hand bringing about a final fixing of the cover plate independently of the described screwless fixing. Preferably by screwing into a central taphole of the pin, preferably a clamp clip, part of the hob or the like can be pressed against the cover plate by a clamp bolt.

A preferred apparatus for fitting a cover plate has a pressing-in tool with which the cover plate is movable against the pin and whose pressing-in elements surrounding the pin bring about a corresponding deformation of the cover plate. This deformation can be partly plastic, but should leave a residual elasticity for maintaining the self-securing action.

Further advantages and features of the invention can be gathered from the subclaims and description in conjunction with the drawings and said individual features can be claimed as novel and inventive either singly or in combination. It is pointed out that these features can advantageously also be used in conjunction with other hotplate types.

BRIEF DESCRIPTION OF THE DRAWINGS

Embodiments of the invention are described hereinafter relative to the drawings, wherein.

DETAILED DESCRIPTION OF THE PREFERRED EMBODIMENTS

Figure 1:
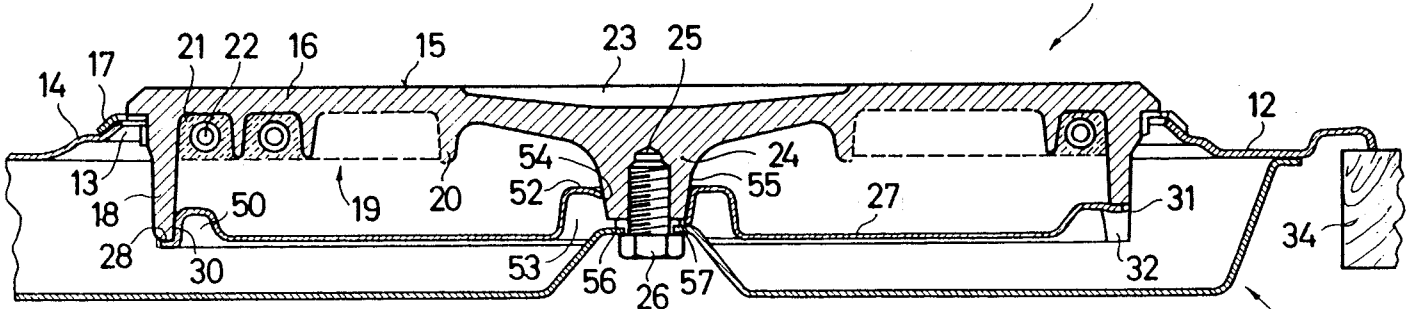
FIG. 1 is a vertical cross-section through an electric hotplate fitted in a hob.
Figure 2:
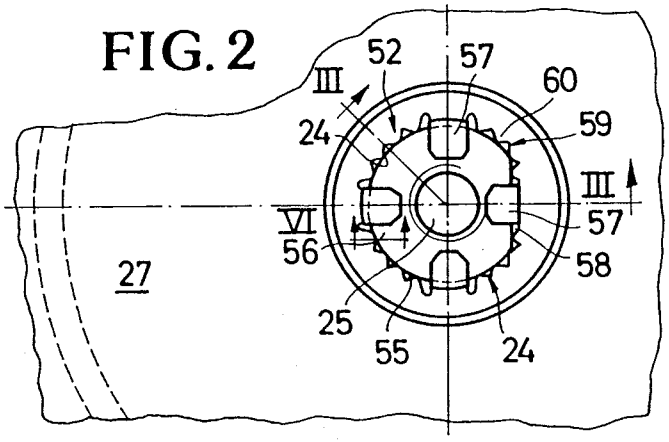
FIG. 2 is a partial view from below of a hotplate.

FIG. 1 shows an electric hotplate 11, which is fitted into a built-in plate 12 of a hob 33, which is in turn inserted into the opening of a work plate 34 of an item of kitchen furniture. The hotplate engages into an opening 13 of the built-in plate 12 and is supported with the built-in rings 17 on a raised sill 14 of the built-in plate.

The hotplate body 16 is made from cast metal, preferably cast iron and has a planar, annular cooking surface 15, which surrounds a somewhat depressed, unheated central zone 23. An outer rim 18 of the hotplate body extends substantially cylindrically downwards and, supported by a flange, carries on the outside the built-in ring 17. On its underside is located a cover plate 27 and is guided on the inside of the outer rim with an all-round cylindrical surface forming the outside of an annular, stamped-in depression 50.

The electric hotplate is heated by helical heating resistors 22, which are located in spirally arranged grooves 21 on the underside of the hotplate body in a heated annular zone 19, which is inwardly defined by a downwardly directed inner rim 20. The heating resistors are embedded in electrically insulating embedding material.

A cast central pin 24 is provided in the unheated central zone 23 and projects downwards to roughly the same degree as the outer rim 18 and tapers downwards somewhat (to the order of magnitude of the mold removal bevel). It has a central taphole 25, into which can be screwed a fastening screw 26, which secures the hotplate against a lower clamping-fixing plate 33. In place of this lower hob plate, it is also possible to provide a separate clamping clip or other fixing means, which is e.g. supported in the vicinity of sill 14.

In the lower edge 28 of outer rim 18 is circumferentially provided a recess 32, into which engages a corresponding shaped part 31 of cover plate 27. This fixes the cover plate in a predetermined rotational position on the hotplate body, its further centering being brought about by a centering shoulder 30 connected to the annular depression 50.

A screwless fixing means 52 is provided in the area surrounding pin 24 for fixing the cover plate 27 to the hotplate body. For this purpose said central area is provided with a cup-shaped, upwardly directed stamped-out part or stamping 53, whose upwardly directed bottom has an opening corresponding to the outer cross-sectional shape of the pin 24 at the corresponding point, but is somewhat smaller. This leads to gripping edges 54, which are directed towards the outer face 55 of the pin and engage in self-locking manner thereon if the fixing means, together with the cover plate are pressed onto the outer face of pin 24.

In place of the gripping edges 24, flaps 45 are shaped onto individual points, e.g. at two to four points of the circumference (or are defined by material left in place after the stamping of the opening), which pass downwards on the outer face 55 of pin 24 and then engage on the face 56 of the pin, where they form bearing portions 57, but leave the taphole 25 free between them. FIG. 1 shows that the bottom of the hob forming the clamping part 33 has at the fixing point an upwardly directed stamping and is pressed against the same from the head of fastening screw 26, so that the cover plate 27 is finally fixed and is also conductively connected to the remaining parts of the hob for grounding purposes and this correspondingly applies for other clamping parts.

Figure 3:
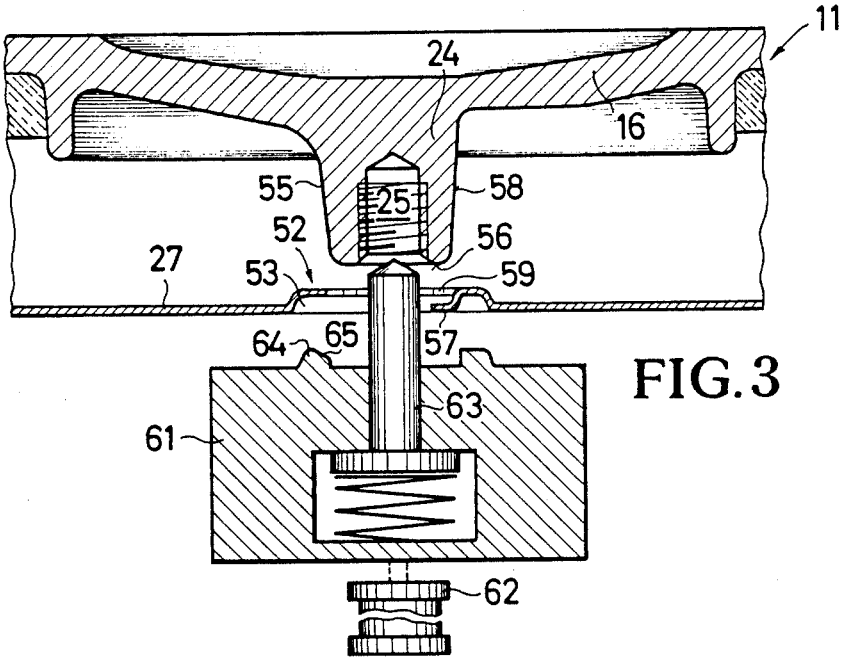
FIG. 3 is a section along line III in FIG. 2 with the representation of an apparatus for fitting the cover plate prior to its fitting to the electric hotplate.
Figure 4:
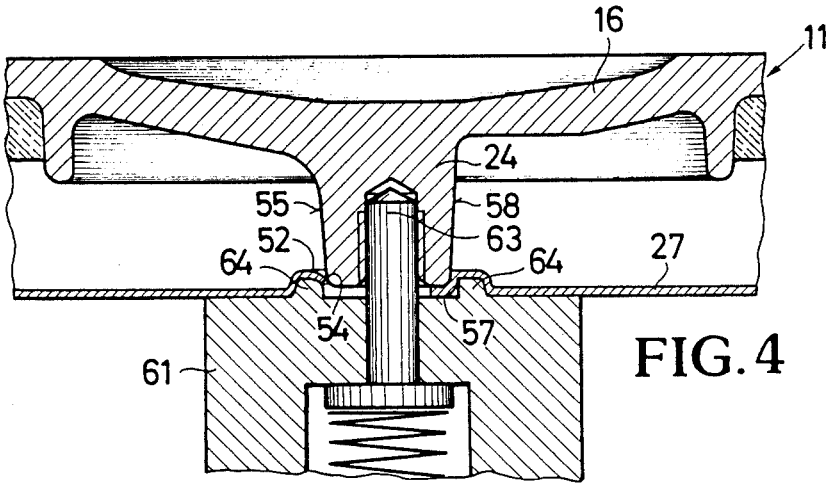
FIG. 4 is a section according to FIG. 3 after fitting to the electric hotplate.
Figure 5:
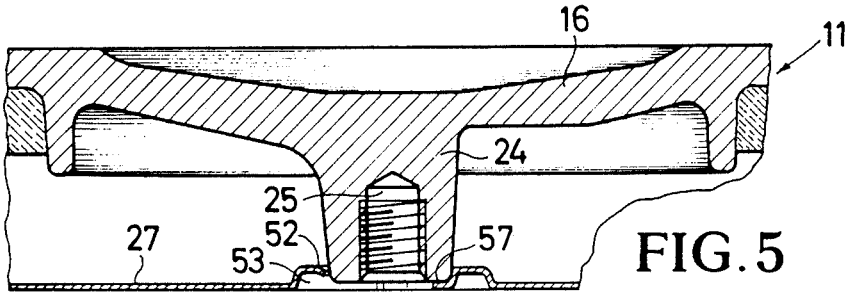
FIG. 5 is a partial section through the hotplate ready for assembly.

FIGS. 3 to 5 show a preferred, slightly modified embodiment, in which the fixing means 52 are formed by elements, which are separated from one another by indentations. These indentations are approximately triangular and are not very deep, so that a type of knurling is obtained or an inwardly directed star, whose tips form the gripping edges 54. Four bearing portions 57 in the form of upwardly bent flaps are formed. It can also be seen that in this embodiment pin 24 has a flattened portion 58, which is formed by a substantially vertical plane. The opening between the fixing means is adapted to this shape, so that as a result a rotation preventing means is formed.

FIG. 3 shows that a fixing means 52 which are not provided, as in FIG. 1, on the upper base of a cup-shaped stamping, there being instead a relatively flat, channel-like depression. FIGS. 4 and 5 show this shape after fitting. It can be seen that stamping 53 is only sufficiently deep for the gripping edges 54 to engage on a cylindrical or slightly conical part of the outer face, i.e. above any possible rounding or the like.

Prior to fitting, cover plate 27 is stamped in the form shown in FIG. 3, i.e. a flat stamping 53 is made and from it is punched opening 59, the radial structure with individual elements 60 of the fixing means being produced, simultaneously the flaps forming subsequently bearing portions 57 are shaped and are brought into their basic form. The internal dimensions of the opening 59, i.e. the distance between tips 54 of elements 60 are smaller than the corresponding external dimensions of pin 24.

The following method is used for fitting purposes. A pressing in device shown in FIGS. 3 and 4 contains a pressing in tool 61 in the form of a punch, which can be movably advanced by means of a power drive 62 against the underside of the hotplate. The pressing in tool 61 has a resilient, central guide pin 63, which cooperates with the taphole 25 and positions the tool during the pressing in operation with respect to the hotplate, as well as pressing in elements 61 arranged annularly around the position provided for the pin and which in cross-section have a cam-like shape. They engage in the pre-stamped stamping 53 and, as a result of their inwardly dropping bevel 65, form the fixing means 52, i.e. the parts of the cover plate immediately adjacent to the rim of opening 59 and consequently also the elements 60 on pressing onto the pin can slope inwards and downwards, so that they assume a barb-like configuration. The bevel or slope 65 should be such that, while taking account of all the tolerances of the cover plate and pin, when pressing on the fixing element there is no direct engagement therewith. As a result of the locking angle a, shown in FIGS. 6 and 7, between the fixing means 52 and outer face 55, which can vary in accordance with material and surface characteristics and can be between 30° and 80° (preferably between 60° and 80°), a self-locking action is obtained, which interacts particularly well with the rough casting surface of the pin. The remaining parts of the pressing in tool largely correspond to the shape of stamping 53, which is therefore supported and is scarcely modified. Thus, the material only gives in the vicinity of bevel 65. The bearing portions 57 are supported in shape-retaining manner by the pressing in tool.

Thus, it is possible to fix the cover plate with a working stroke of a simple tool and no additional fixing parts such as e.g. screws or the like are required. It would admittedly also be possible to fit the fixing means, e.g. in the form of a separately manufactured, spot-welded locking ring to the cover plate, but in most cases the latter is made from such a hard and elastic material, that it can itself assume this function and the fixing means can be cut from its material.

Figure 8:
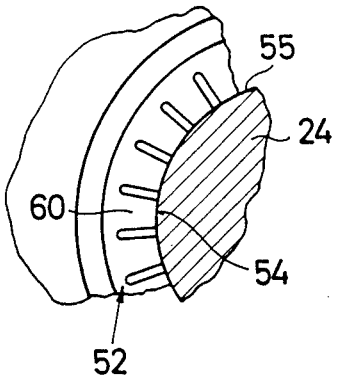
FIG. 8 is a partial view from below of a cover plate with a different fixing means construction.

FIG. 8 shows a modified construction of the fixing means 52, which in this case are flaps separated from one another by indentations, so that the gripping edges 54 are in the form of circular segments and do not have tips, as in the construction according to FIGS. 2 to 5. Preference is given to this embodiment in the case of harder plate materials and when the pin 24 can have greater dimensional variations, because the longer, trapezoidal elements 60 lead to a greater elasticity reserve.

The cover plate can be correctly positioned with respect to the hotplate at the time of fitting. The positioning of the rotary position is ensured by the depression 31 in the rim during the automatic handling of the hotplates and into same engages part of an assembly device. If the cover plate is pressed on, then the corresponding recess 32 in the cover plate rim engages therein, so that the cover plate is simultaneously secured in the turning direction (optionally additionally to the securing action by the flattened portion 58), but this can also be eliminated.

Figure 9:
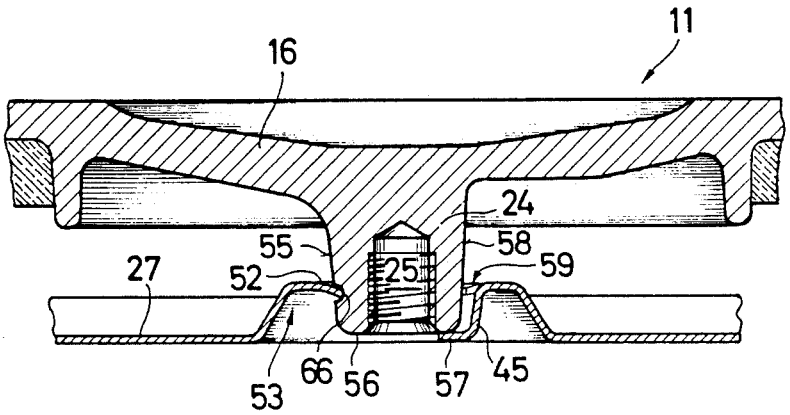
FIG. 9 is a representation of a fixing variant corresponding to FIG. 3.

In the construction according to FIG. 9 pin 24 has a depression 66 in the form of an all-round groove, which can e.g. be obtained by a recessing tool during the facing of face 56 or during drilling and thread cutting for opening 25. The shape of the cover plate is similar to that in FIG. 1 and engages with its fixing means in groove 66 during pressing on and is secured there in positive manner. This version admittedly requires a certain additional expenditure during the working of the hotplate body, but ensures a positionally correct fixing. In place of an all-round groove 66, it would also be possible to have a horizontal indentation, in which only part of the fixing means engages. In the case of such a construction and in particular if a flattened portion is provided, a bayonet-like locking is also possible. For this purpose the fixing means will be constructed in such a way that the cover plate could slide onto pin 24 largely without any deformation, and by a relative rotation of the cover plate, projecting fixing portions pass into the groove. With its recess 32 on the rim, the cover plate could then be made to snap into the rim depression 31, so that it would no longer be readily possible to turn back into the insertion position for release purposes. However, this construction presupposes that the cover plate and hotplate body can be reciprocally turned by a certain angle without this being impeded by connection parts, e.g. power supply lines. However, this would permit fixing without any significant deformation of the cover plate. However, preference is given to the mounting by axial compression, in the manner described.

Figure 7:
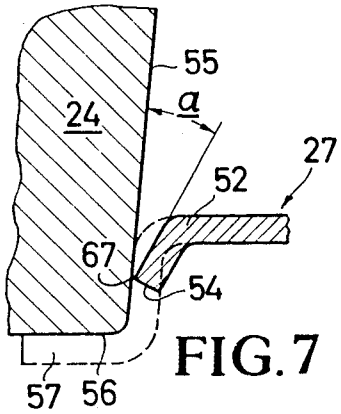
FIGS. 6 and 7 are two larger scale details in the fixing regions along line VI of FIG. 2.
Figure 6:
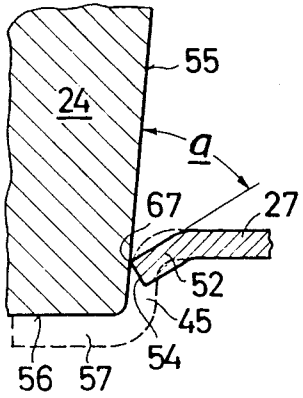

Thus, the invention leads to a particularly simple, screwless fixing, which is ideally adapted to the conditions. The cover plate is fixed without the need for separate fixing means and during subsequent installation can be additionally secured by bearing portions 57. The still simplest and most reliable fixing method for the electric hotplate to the cooker by means of a bolt 26 can be maintained unchanged and for this purpose only a simple standard cap screw is required. Numerous modifications are possible within the scope of the invention, particularly with regards the shape of the fixing means, to whose special construction can be adapted the characteristics of the material of the cover plate and/or the pin, so as to obtain a particularly good hold with a very simple tool and limited fitting effort and force. This is helped if the burr formed during punching is used for providing an additional edge or cutting edge, which helps to improve the hold. Punching should consequently be carried out in such a way that the punching burr 67 is formed on the edge which can preferably penetrate the material, e.g. the upper (inner) edge of the cover plate in the vicinity of opening 59 (FIGS. 6 and 7). The depth of the stamping 53 can vary as a function of the shape of the cover plate. Optionally the resulting cylindrical portion of the stamping can be used for influencing the rigidity or elasticity of the fixing means.

Figure 10:
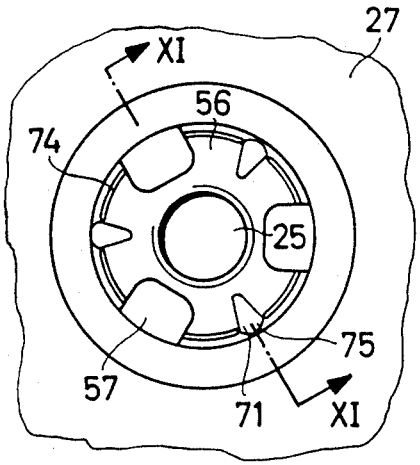
FIG. 10 is a detailed view from below of the central part of a cover plate fitted to the pin.
Figure 11:
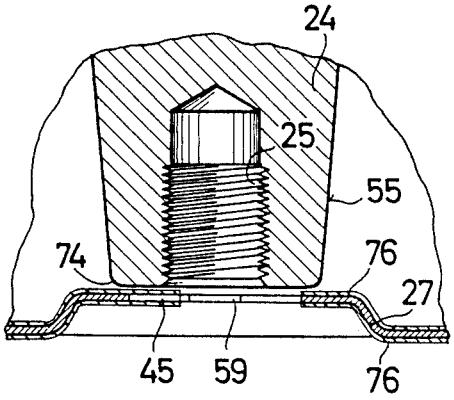
FIG. 11 is a vertical detail section along line XI in FIG. 10, but prior to the deformation and fitting of the cover plate.
Figure 12:
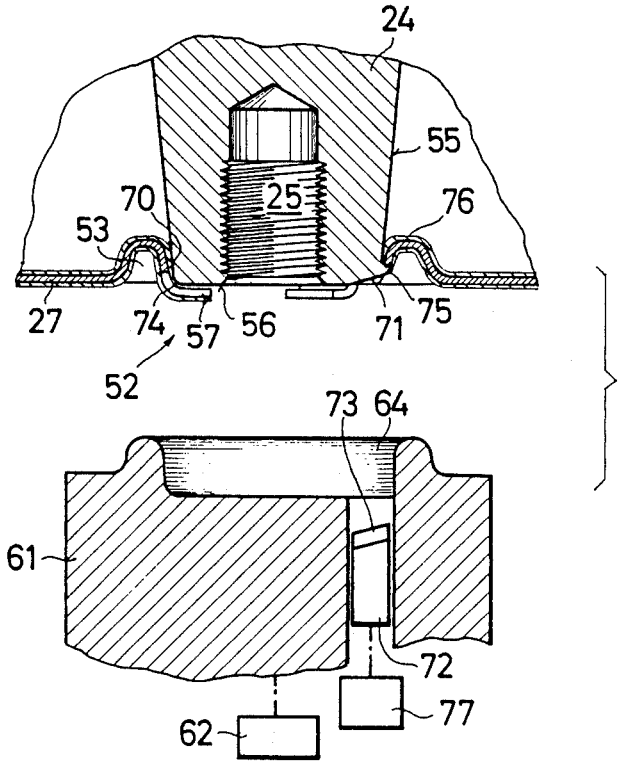
FIG. 12 is a section corresponding to FIG. 11 after fitting and deforming the cover plate and pin.

The same reference numerals are used in the construction according to FIGS. 10 to 12 as hereinbefore and it corresponds to the embodiments previously described with the exception of the following points. In the cover plate is provided depression 53 and opening 59, which is a circular opening with a smaller diameter than that of face 56 of pin 24 and into it project the three flaps 45. This pre-fitting shape is shown in FIG. 11.

With the aid of the pin 24 serving as the male tool half, the pressing-in tool 61 shapes the central region of cover plate 27 in the manner shown in FIG. 12. This once again leads to the channel 53 from which the flaps extend in angular manner towards face 56 and form the bearing portions 57 there. The portions of the cover plate engaging on the outer face 55 of pin 24 are in this construction in the form of a collar 70 extending downwards in nozzle-like manner, which largely engages flat on outer face 55 and does not necessarily have a self-locking action, even though a very good hold is obtained in conjunction with the rough casting surface. However, the cover plate is prevented from sliding from pin 24 by a separate measure, namely through notches 71 made from below following the working with the pressing-in tool (FIGS. 10 and 12). These notches are made by one or more striking tools 72 (FIG. 12), which has three radially directed, roof-like, sloping notch edges 73. It is integrated into the pressing in tool and is operated subsequently to the working thereof, e.g. by a diagrammatically represented striking mechanism 77, which acts on the three striking tools 72 and can e.g. be a releasable spring mechanism. The notches 71 are located in sloping manner in the vicinity of the marginal edge 74 of the pin connecting the circumferential surface 55 to face 56 and in each case produce a projection 75 projecting beyond the circumferential surface 55 and secures the cover plate against removal from the pin in the vicinity of collar 70. It has been found that this connection type in which the main fixing is preferably provided by the collar 70 and projections 75 only prevent removal, said projections 75 being very small, is possible although the cast material of the hotplate body does not in itself permit significant deformation. However, this is made possible by the striking tools. It has also been found that it is also possible to bridge certain diameter tolerances in the cast pin 24, without any material tearing tendency in the vicinity of the collar and instead a completely satisfactory nozzle-like collar is formed, which ensures a reliable seating of the cover plate.

This is particularly helped by the fact that the cover plate is generally provided on both sides and certainly always on the upwardly directed inside with a thin aluminium coating or plating 76. As aluminium is a softer material than the steel plate forming the cover plate 27, it forms a lubricating coating during deformation, which prevents any wearing of the steel plate on the cast pin and significantly contributes as a result of this to a crack-free deformation. The aluminium coating of the steel plate also has the advantage that a corrosion-preventing layer is obtained on heating as a result of an intermetallic connection between the aluminium and the steel.

This construction with an all-round, uninterrupted collar 70 has the advantage that the cover plate is tightly sealed in the vicinity of pin 24, so that the space between the hotplate body and the cover plate can also be kept largely tight and therefore protected against moisture. This is also helped by the aluminium coating, because during deformation it has adapted to the surface structure of the pin.

We claim:

1. An electric hotplate, comprising:

a hotplate body having an upper side and an underside, the upper side being a cooking surface, the underside being provided with a central, downwardly-projecting pin having an outer face;

a cover plate covering the underside and fixed to the hotplate body, the cover plate having a central recess and being fixed by screwless fixing means operative between the outer face of the pin and the recess of the cover plate, said recess surrounding the pin and the pin having projections securing the cover plate to the pin, which projections are formed by notching of a lower face of the pin below the cover plate, the projections extending into a marginal region of the lower face.

2. An electric hotplate, comprising:

a hotplate body having an upper side and an underside, the upper side being a cooking surface, the underside being provided with a central, downwardly-projecting pin having an outer face, and at least one heating resistor disposed in an embedment within an outer rim of the hotplate body;

a cover plate covering the underside and fixed to the hotplate body, the cover plate having a central recess and being fixed by screwless fixing means operative between the outer face of the pin and the recess of the cover plate, said recess surrounding the pin and being defined by an upwardly-directed cup-shaped portion of the cover plate with a ring-shaped part having an opening provided therein, the fixing means including a rim of the opening, the portion being nozzle-shaped and tightly surrounding the pin and being obtained by pressing the cover plate onto the pin, the cover plate being provided at least on a side of the cover plate directed toward the hotplate body with an aluminum coating, and the cover plate being spaced from the hotplate body and from the embedment of the heating resistors in the hotplate body, between the pin and the outer rim of the hotplate body.

3. The electric hotplate according to claims 2 or 1, wherein the fixing means can be applied to the cover plate by a pressure acting upwards in the direction of pin.

4. The electric hotplate according to claim 3, wherein the outer circumference of the cover plate rests on a lower edge of a downwardly directed outer rim provided in an outer circumferential region of the hotplate body and with an upwardly directed stamping of a cover plate rim engages in a depression of the lower edge.

5. The electric hotplate according to claim 2 or 1, wherein the fixing means are resilient.

6. The electric hotplate according to claim 2 or 1, wherein the fixing means formed from the material of the cover plate has at least one gripping edge provided at the rim of recess in the cover plate.

7. The electric hotplate according to claim 6, wherein a portion of the gripping edge engaging on pin is formed by a punching burr.

8. The electric hotplate according to claim 2, wherein the fixing means engages in a depression on the outer face of pin.

9. The electric hotplate according to claim 2, wherein in the fitted state, the fixing means cooperates in barb-like manner with a downwardly slightly conically tapered outer face of the pin.

10. An electric hotplate, comprising:

a hotplate body having an upper side and an underside, the upper side being a cooking surface, the underside being provided with a central, downwardly-projecting pin having an outer face;

a cover plate covering the underside and fixed to the hotplate body, the cover plate having a central recess and being fixed by screwless fixing means operative between the outer face of the pin and the recess of the cover plate, the fixing means being formed by a plurality of elements projecting inwards toward the pin, bounded by indentations in a rim of the recess.

11. An electric hotplate, comprising:

a hotplate body having an upper side and an underside, the upper side being a cooking surface, the underside being provided with a central, downwardly-projecting pin having an outer face and a lower face with a central taphole;

a cover plate covering the underside and fixed to the hotplate body, the cover plate having a central recess and being fixed by screwless fixing means operative between the outer face of the pin and the recess of the cover plate, the cover plate having bearing portions in a vicinity of the recess, the bearing portions engaging below the lower face of the pin, around the central taphole.

12. The electric hotplate according to claims 10 or 11, wherein the generally circular pin has a flattened portion cooperating with correspondingly designed portions of the recess for preventing rotation of the cover plate.

13. The electric hotplate according to claim 11, wherein the bearing portions are flaps shaped onto a rim of an opening provided in the recess and run along an outer surface of the pin towards its face.

14. An electric hotplate, comprising:

a hotplate body having an upper side and an underside, the upper side being a cooking surface, the underside being provided with a central, downwardly-projecting pin having an outer face and a lower face with a central taphole;

a cover plate covering the underside and fixed to the hotplate body, the cover plate having a central recess and being fixed by screwless fixing means operative between the outer face of the pin and the recess of the cover plate, the fixing means including a bayonet locking means fixable by relative rotational movement of the cover plate relative to the hotplate.

15. An apparatus for fixing a cover plate to a central pin on an underside of a hotplate body of an electric hotplate with a fixing means, comprising:

a pressing-in tool having pressing-in elements surrounding a central pin on an underside of a hotplate body and movable towards the underside of the hotplate body and being thereby operable to press a cover plate onto the pin, the cover plate being provided with a central recess by deformation of marginal regions of the cover plate adjacent the recess, the pressing-in tool including a device operable to make a notch in a vicinity of a lower marginal edge of the pin.

16. The apparatus according to claim 15, wherein the pressing-in elements have shaping faces shaping the fixing means in a locking, sloping alignment counter to the pressing in direction.

17. A method for fitting a cover plate to a central pin on an underside of a hotplate body of an electric hotplate, the cover plate having an opening in a vicinity of the pin, comprising the steps of:

pressing the cover plate onto the pin, deforming marginal regions of the cover plate surrounding the opening to produce a collar-like configuration, and during the deformation lubricating between the cover plate and the pin by providing on the cover plate a metal coating of a material which is softer than a material of the cover plate.

18. The method according to claims 17, comprising subsequent to the pressing on, striking the pin to form projections on the outer circumferential surface of the pin.

* * * * *